United States Patent [19]

Tye

[11] 4,075,913

[45] Feb. 28, 1978

[54] REMOTELY OPERABLE MECHANISM FOR DISCONNECTING A PICKUP UNIT FROM A TILT-UP CONCRETE WALL SLAB

[75] Inventor: Dennis W. Tye, Hayward, Calif.

[73] Assignee: Superior Concrete Accessories, Inc., San Diego, Calif.

[21] Appl. No.: 750,913

[22] Filed: Dec. 15, 1976

[51] Int. Cl.[2] ..... B25B 13/48

[52] U.S. Cl. ..... 81/177 UJ; 81/3 R

[58] Field of Search ..... 81/3 R, 53.1, 177 F, 81/177 R, 177 UJ

[56] References Cited

U.S. PATENT DOCUMENTS

| | | | |
|---|---|---|---|
| 1,324,898 | 12/1919 | Hopcraft | 81/177 UJ |
| 1,987,584 | 1/1935 | Bodendieck | 81/3 R |

*Primary Examiner*—Al Lawrence Smith
*Assistant Examiner*—James G. Smith
*Attorney, Agent, or Firm*—Norman H. Gerlach

[57] ABSTRACT

A remotely operable mechanism for disconnecting an elevated pickup unit component of lifting apparatus from a tilt-up concrete wall slab in raised position following a lifting operation, the pickup unit being connected to the slab by fastening means engaging an insert embedded in the slab wall, includes a manipulating pole serving as an operating handle, and a flexible fastener coupling tool having a proximal end removably connected to one end of the pole and a free distal end opposite thereto, the connected pole end being uppermost on the pole in use. The tool has at its distal end a head releasably engageable with the fastening means and operable for disengaging the same from the insert to thereby release the pickup unit for removal from the wall slab. The tool includes a universal joint extending between and flexibly coupling the head and the proximal end of the tool, whereby the tool may be rotated by rotation of the pole while the pole is angularly disposed relative to the axis of rotation of the head. The tool also includes spring means interposed between the head and the proximal end of the tool for extending the tool coaxially with the pole while enabling the tool to bend for engaging the head with the fastening means. The tool head is movable into its engagement with the fastening means and operable when the latter is disposed at a location above and remote from an operator of the mechanism by manipulation including rotation of the pole grasped adjacent to its lower end.

14 Claims, 23 Drawing Figures

40
46
42
7
44
38
32
232
226
188
230
190
242
34
66
192
237
240
186
30
36
110
150
152
224
218
220
192a
104
222
148
198
196
193a
8
205
192b
193
194
9
194c
194d
248
250
246

46
48
50
66
70
68
72
126
100
106
104
74
78
44
42
110
38
218
192
40
32
34
186
30
228
232
36
226
188
237
240
190
242
238
230
48a
58
199
198
192d
204
205
192b
201
202
200
203
193

46
66
48
50
78
70
68
72
100
38
106
104
218
74
44
110
42
40
32
186
192
30
230
226
194
206
226
194a
214
212
194c
216
210
208
194d
230
228
194b
232
194
238
242
237
242
240
190

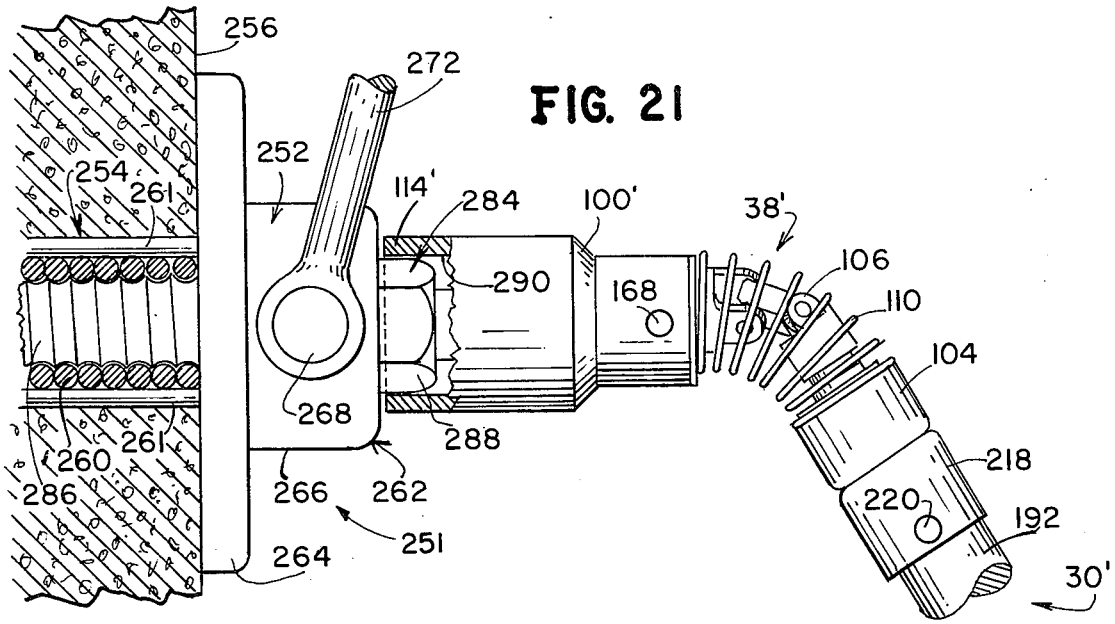
FIG. 21
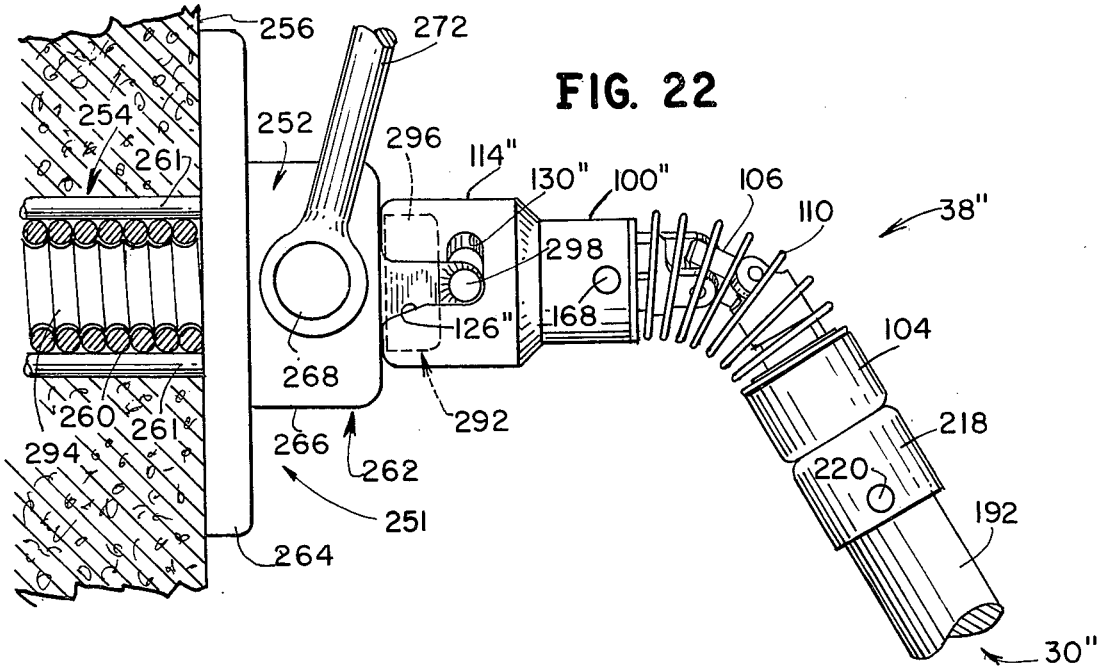
FIG. 22
FIG. 23
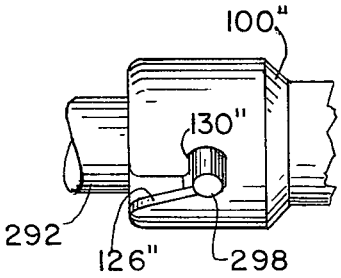

REMOTELY OPERABLE MECHANISM FOR DISCONNECTING A PICKUP UNIT FROM A TILT-UP CONCRETE WALL SLAB

BACKGROUND OF THE INVENTION

This invention relates to mechanism for disconnecting an elevated pickup unit component of lifting apparatus from a tilt-up concrete wall slab in raised position following a lifting operation, the lifting apparatus also including an insert embedded in the slab and the pickup unit being connected to the slab by fastening means engaging the insert. More particularly, the invention relates to mechanism including a flexible fastener coupling tool which may be operated remotely for disengaging such fastening means from the insert when the fastening means is disposed at a location above and remote from an operator of the mechanism.

Tilt-up construction is a job-site form of precast concrete construction. It involves prefabricating concrete wall slabs or panels flat on either the building floor slab or a temporary casting slab, then lifting or "tilting" them up with a mobile crane and carrying them to their final locations, where they are installed as vertical walls and become integral parts of the completed structure. In the erection of a tilt-up wall slab, a concrete slab is connected temporarily to lifting or hoisting equipment, utilizing accessory lifting apparatus connected to the slab. The lifting apparatus includes an anchor insert which is embedded permanently in the slab, and a pickup unit which is releasably connected to the insert and thereby the slab, by fastening means engaging the insert. The pickup unit also is releasably connected to the lifting equipment. In use, a plurality of inserts is embedded in a concrete slab by pouring wet concrete therearound and setting the concrete, and a pickup unit is connected to each embedded insert and also to the lifting equipment. The lifting equipment is operated to raise the slab from a horizontal position in which it is cast, to a vertical position in which it serves as a building wall. The wall slab is braced, the pickup units are disconnected from the slab, by disengagement of the fastening means from the inserts, and the wall slab is integrated into the building structure. The inserts remain embedded in the slab, and the pickup units may be used repeatedly with inserts embedded in additional wall slabs. Lifting apparatus for a tilt-up concrete wall slab is illustrated in U.S. Pat. Nos. 3,431,012 and 2,794,336, the latter also illustrating the manner in which the lifting operation is accomplished.

The pickup units to be disconnected after a wall slab has been raised by the tilt-up construction method are in elevated positions on the face of the slab. It is necessary for workmen to scale the slab in some manner for disconnecting the units, usually on ladders placed against the wall slab and supported by the floor slab. One man climbs the ladder, and another man is required to hold the ladder. The man on the ladder must reach out and loosen and/or remove a fastening member, and it may be necessary to pull out a pickup unit weighing over 20 pounds. Meanwhile, the workmen are working beneath a crane and its lifting equipment. The pickup units are lowered to the ground by the crane cables.

The foregoing method of removing the pickup units has been used for many years. However, risks are involved when the men are disconnecting the units while standing on ladders and working beneath the crane rigging, and proportionate expenditures of manpower and time are required. It would be highly advantageous to eliminate the need for conducting such operations from ladders or other elevated equipment, by providing remotely operable mechanism for disconnecting the pickup units, enabling the units to be removed by workmen remaining at ground level.

SUMMARY OF THE INVENTION

The invention provides remotely operable mechanism for disconnecting an elevated pickup unit component of lifting apparatus from a tilt-up concrete wall slab, which mechanism includes the combination of a manipulating pole serving as an operating handle and a flexible fastener coupling tool removably connected thereto. The mechanism is readily operated by one man standing on the ground, at distances of, for example, over 20 feet from the pickup unit. Less manpower is required, and the operation is quicker and safer than removal of the pickup units by working from ladders. The mechanism may be constructed as a lightweight assembly, so as to minimize strain on the workmen. The mechanism is adaptable to various designs of lifting apparatus, and it is capable of interchangeable use on several designs. The mechanism may in some cases be used to lower the pickup unit to the ground, so that it is unnecessary to use the crane cables for this purpose.

More particularly, the invention provides in remotely operable mechanism for disconnecting an elevated pickup unit component of lifting apparatus from a tilt-up concrete wall slab in raised position following a lifting operation, the lifting apparatus also including an insert embedded in the slab and the pickup unit being connected to the slab by fastening means engaging the insert, the combination of a manipulating pole serving as an operating handle and a flexible fastener coupling tool having a proximal end removably connected to one end of the pole and a free distal end opposite thereto, the connected pole end being uppermost on the pole in use, the tool having at its distal end a head releasably engageable with the fastening means and operable for disengaging the same from the insert to thereby release the pickup unit for removal from the wall, the tool including a universal joint extending between and flexibly coupling the head and the proximal end thereof, whereby the tool may be rotated by rotation of the pole while the pole is angularly disposed relative to the axis of rotation of the head, the tool also including spring means interposed between the head and the proximal end thereof for extending the tool coaxially with the pole while enabling the tool to bend for engaging the head with the fastening means, the tool being movable into its engagement with the fastening means and operable when the latter is disposed at a location above and remote from an operator of the mechanism by manipulation including rotation of the pole grasped adjacent to its lower end. The invention also includes the combination of the foregoing disconnecting mechanism with lifting apparatus, which apparatus includes an insert and a pickup unit, and it further includes the fastener coupling tool of the mechanism per se.

BRIEF DESCRIPTION OF THE DRAWINGS

The attached drawings illustrate preferred embodiments of the invention, without limitation thereto. In the drawings, like elements are identified by like reference symbols in each of the views, and:

FIG. 21 is a fragmentary side elevational and partly sectional view of mechanism according to the invention having a modified tool head, for engagement with a third type of fastening means, employed with lifting apparatus similar to that illustrated in FIGS. 19 and 20;

FIG. 22 is a fragmentary side elevational and partly sectional view of mechanism according to the invention having a tool head constructed similarly to that of FIGS. 1–20, for engagement with a fourth type of fastening means, employed with lifting apparatus similar to that illustrated in FIGS. 19 and 20; and FIG. 23 is a fragmentary side elevational view representing a portion of FIG. 22, illustrating the tool head and the fastening means in rotated positions with respect to FIG. 22.

DESCRIPTION OF THE PREFERRED EMBODIMENTS

Figures 1, 2, 3, 7:
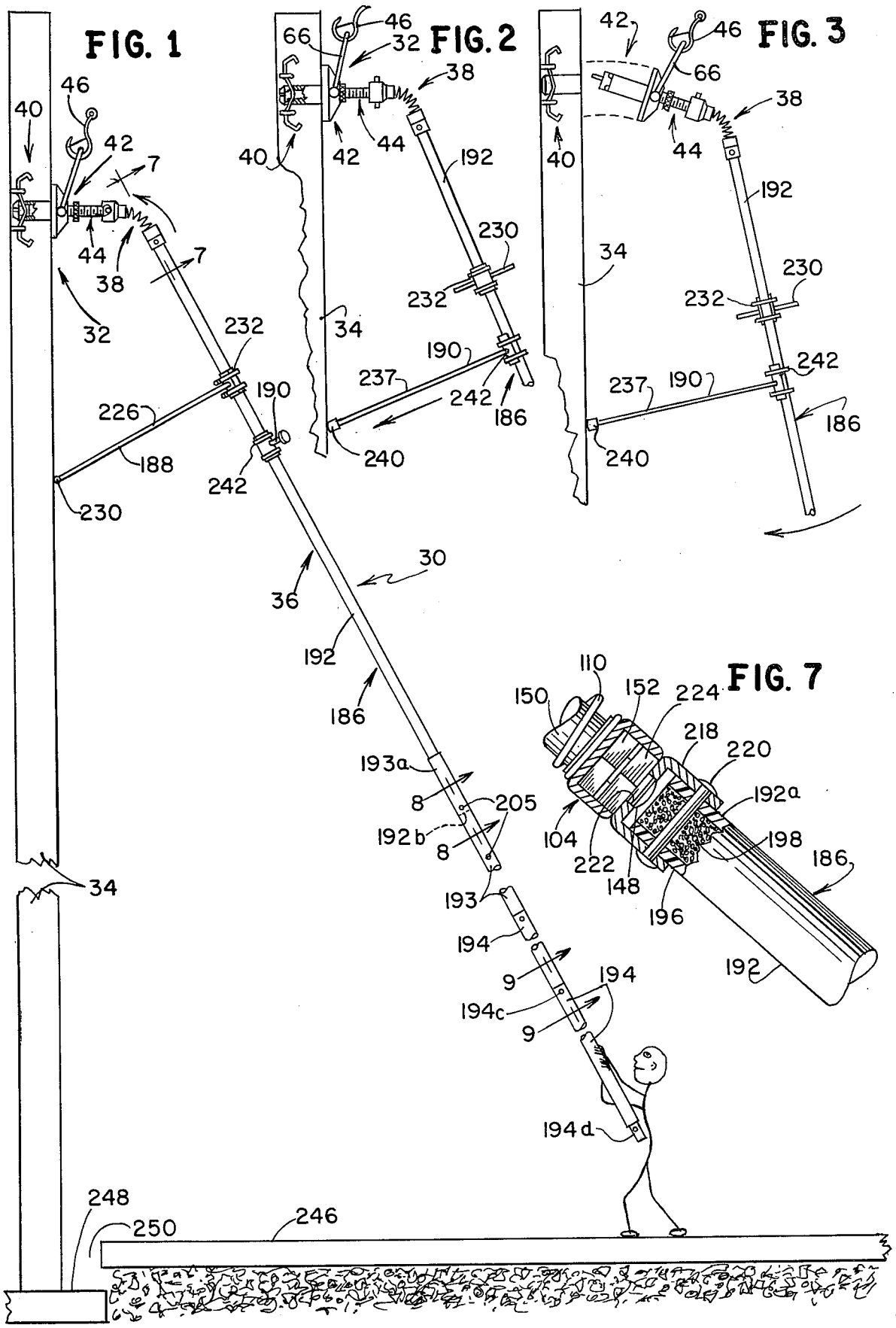
FIG. 1 is a schematic broken side elevational view and FIGS. 2 and 3 are similar fragmentary views of one embodiment of disconnecting mechanism in accordance with the invention, illustrating successive positions which the mechanism assumes in disconnecting a pickup unit from a tilt-up concrete wall slab.
FIG. 7 is a further enlarged longitudinal sectional detail view of a connection made in the mechanism, taken substantially on line 7—7 of FIG. 1.

Referring to the drawings, FIG. 1 illustrates a remotely operable disconnecting or release mechanism or device 30 employed in combination with lifting apparatus 32 for a tilt-up concrete wall slab 34, in accordance with the invention. The mechanism 30 includes a pole assembly 36 and a flexible fastener coupling tool 38 removably connected to the end of the pole assembly 36 which is uppermost in use. The lifting apparatus 32 is conventional, and it includes an insert 40 embedded in the slab 34, and a pickup or lifting unit 42 removably connected to the insert 40 and thus the slab 34 by conventional fastening means 44, which is captive on the pickup unit 42. The mechanism 30 is constructed for disengaging the fastening means and thereby disconnecting the pickup unit 42 from the wall slab 34 when the slab is in a raised or vertical position, as illustrated in FIG. 1, following a lifting operation. The lifting operation is accomplished by attaching a crane hook 46 to each of a plurality of pickup units 42 connected to inserts 40 suitably arranged in the concrete slab 34.

Figure 16:
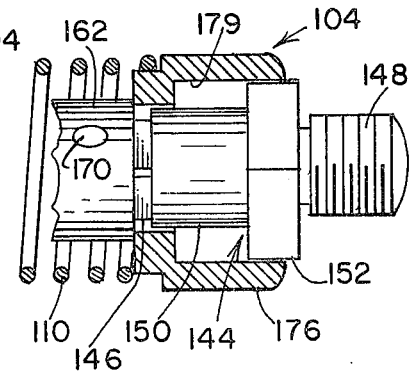
FIG. 16 is a fragmentary longitudinal sectional and elevational view of the coupling tool, similar to FIG. 13 but showing a socket part thereof retracted for the purpose of connecting the tool to a pole assembly in the mechanism.
Figure 17:
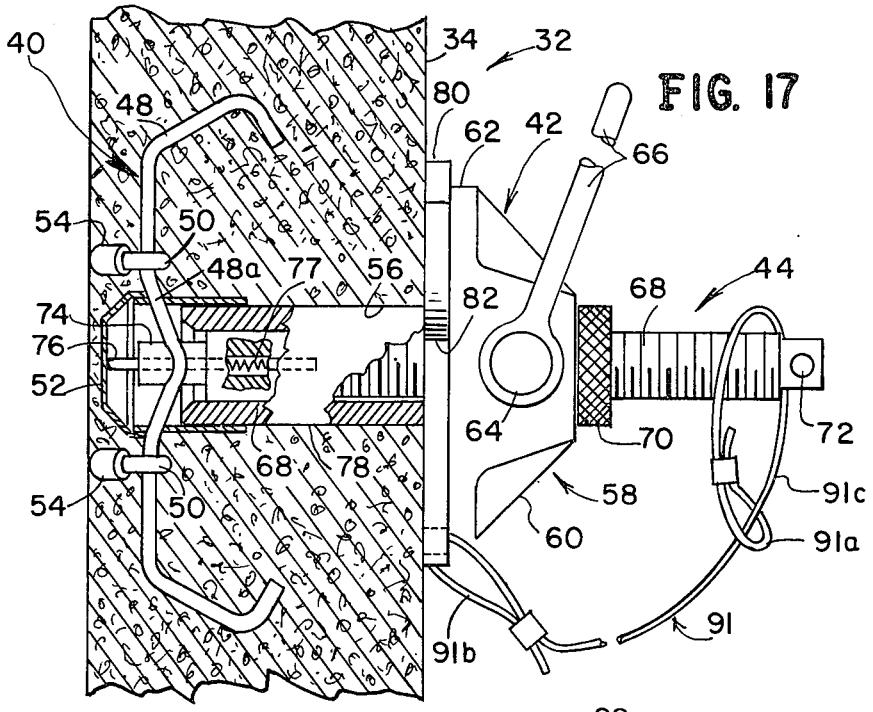
FIG. 17 is a side elevational view with parts broken away and in section of the lifting apparatus illustrated in FIGS. 1—6 but enlarged with respect thereto, with a spacer and bearing member inserted between the concrete wall slab and the base of the pickup unit, as the unit is mounted prior to engagement of the fastening means with the disconnecting mechanism.

FIGS. 1–16 are illustrative of the mechanism 30, illustrated most completely in FIG. 1, which is adapted for use, inter alia, with the lifting apparatus 32 illustrated in detail in FIG. 17. In general, the lifting apparatus 32 corresponds to the anchor insert and pickup unit illustrated in U.S. Pat. No. 3,431,012. Thus, and referring to the nomenclature as employed in the patent, the insert 40 includes pairs of spaced rod sections 48 and 50 arranged perpendicularly to each other, and a cup-like cage 52 which encloses the central portions 48*a* of the rod sections 48 and serves to exclude concrete from around such portions. The insert 40 is supported on the floor of a concrete form, not shown, on the rod sections 50, which are enclosed in elastomeric sleeves 54 at the points of contact with the floor. Concrete is poured in the form, and the insert 40 becomes embedded therein upon hardening. A cylindrical opening 56 is formed in the resulting wall slab 34, in alignment with the cage 52, by an inverted cup-like shield, not shown, which is mounted on the cage 52 during the concrete pour and hardening. Thereafter, such shield is removed, and the pickup unit 42 is connected to the insert 40.

As disclosed in the aforementioned patent, the pickup unit 42 includes a casting 58 formed with a tubular body portion 60 and an integral generally flat rectangular seating flange or base 62. Two trunnions 64 are integral with and project outwardly from opposite sides of the body portion 60, and they pivotally support a U-shaped lifting bail 66. The bail 66 serves for attachment to the crane hook 46, as illustrated in FIG. 1.

The fastening means 44 includes a threaded stem 68 and a locking nut 70 in threaded engagement therewith. A crosspin-type operating handle 72 is fixed to an outer end of the stem 68, and a T-head 74 is integral with the inner end of the stem. A plunger 76 is longitudinally movably mounted in the inner end of the stem 68, and extends outwardly from the T-head 74. A helical compression spring 77 is interposed between the stem 68 and the inner end of the plunger 76. The stem 68 is inserted through the casting 58, and a sleeve-like cylindrical bushing 78 is mounted on the stem therearound, between the T-head 74 and the flange 62 on the casting 58.

Figures 6, 9, 10:
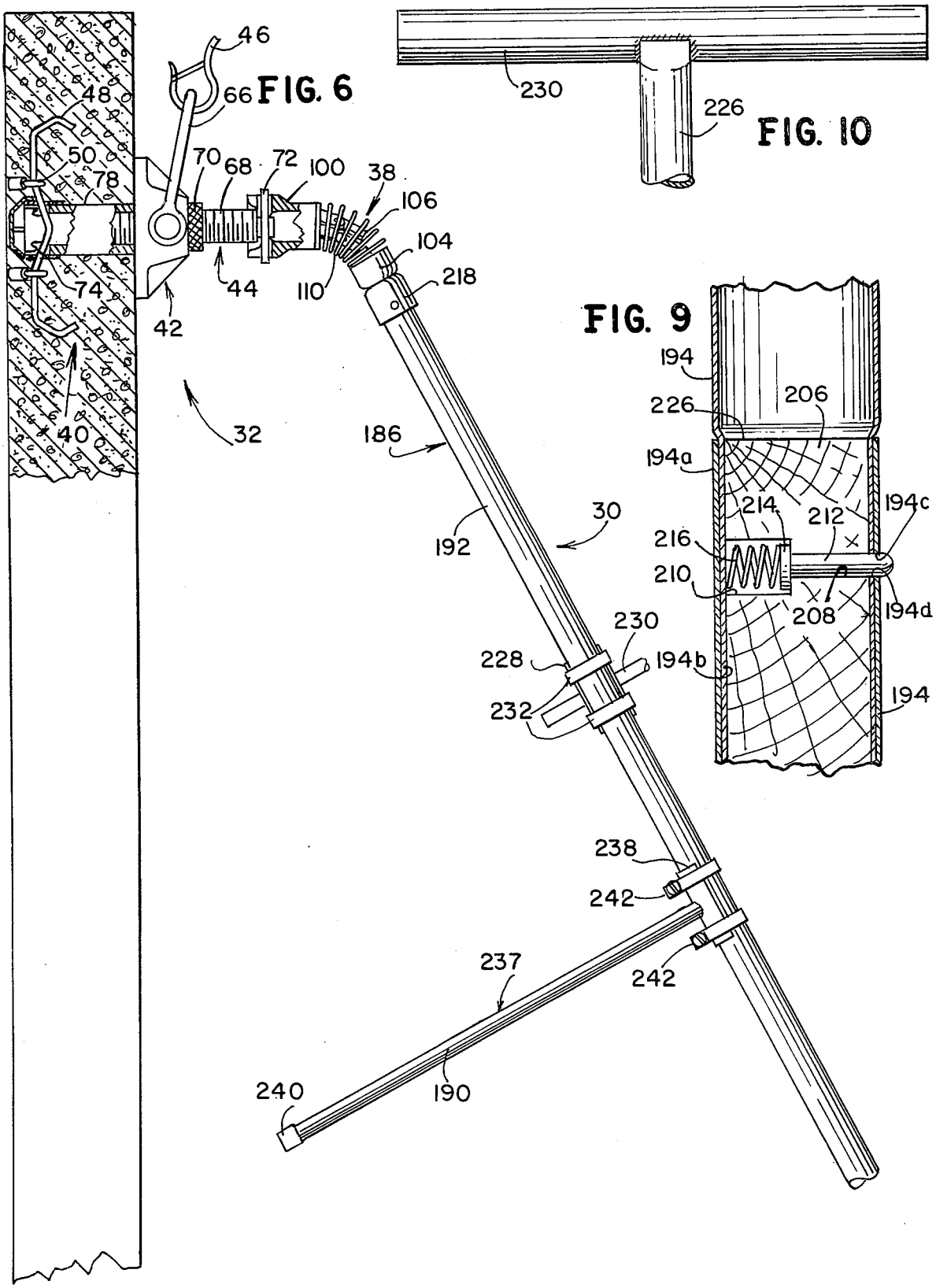
FIG. 9 is a longitudinal sectional detail view of another joint in the mechanism, on the scale of FIG. 8, taken substantially on line 9—9 of FIG. 1.
FIG. 10 is an enlarged plan view of the distal end of a guide member in the mechanism.
Figure 11:
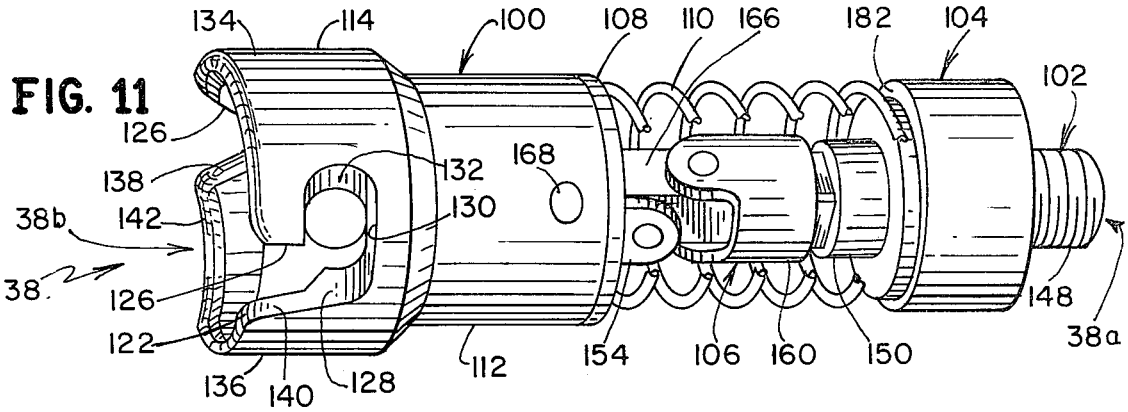
FIGS. 11–15 are enlarged views of a flexible fastener coupling tool in the mechanism, on a scale corresponding to that of FIGS. 8 and 9, FIG. 11 being a perspective view with a spring thereof broken away, FIG. 12 being a side elevational view, FIG. 13 being a longitudinal sectional and elevational view taken substantially on line 13—13 of FIG. 14, FIG. 14 being a distal and elevational view, and FIG. 15 being a proximal end elevational view thereof.
Figure 12:
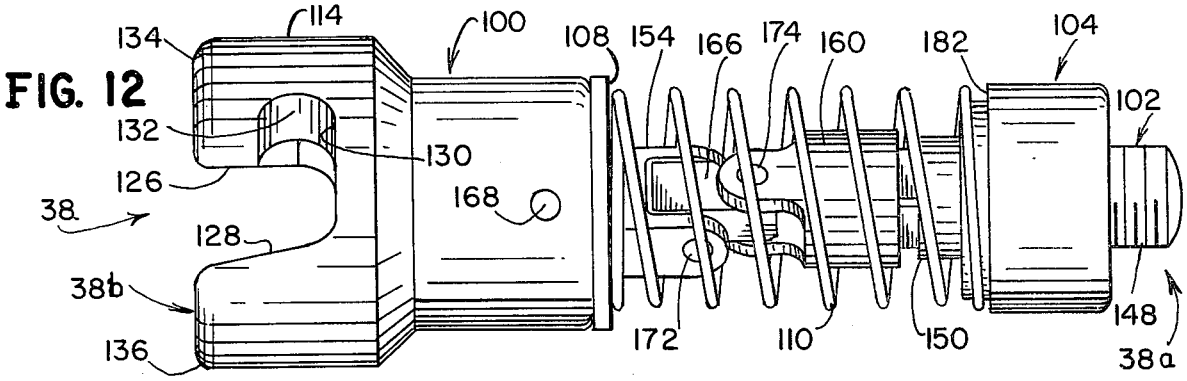
Figure 13:
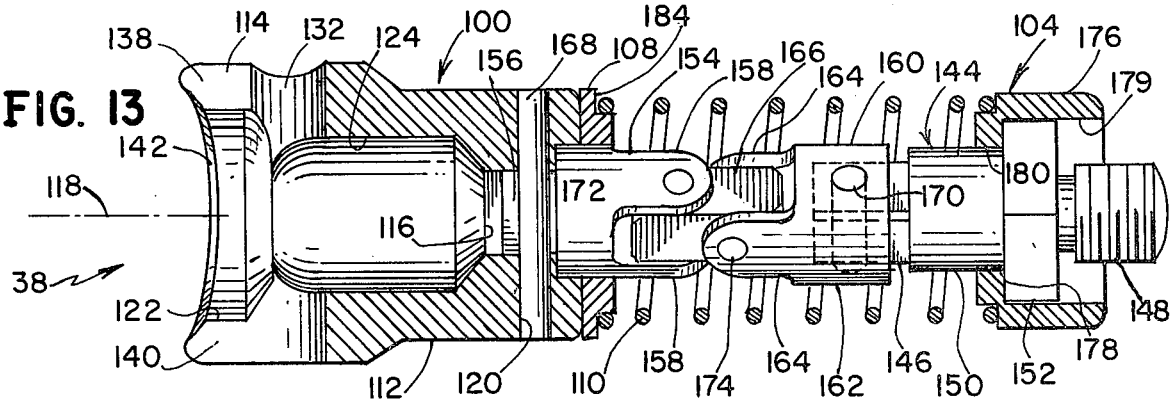
Figure 14:
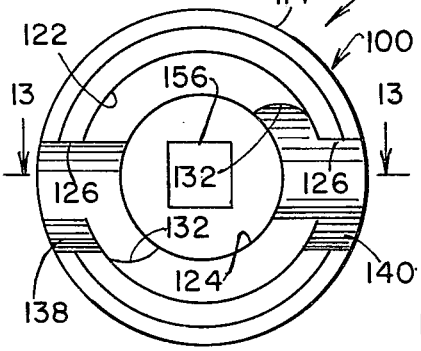
Figure 15:
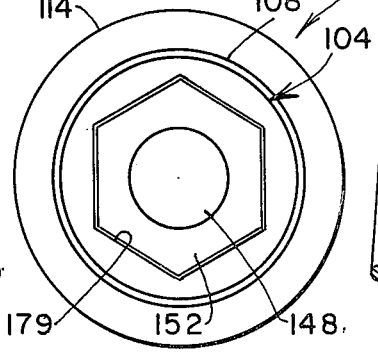

As disclosed in the aforementioned patent, the pickup unit 42 is connected to the insert 40 embedded in the wall slab 34, after the slab is formed and is in a horizontal position ready to be raised. For this purpose, the T-head 74 and the bushing 78 are inserted into the hole 56 in the slab 34 and into the cage 52. The T-head 74 at this time is oriented so that it will pass between the rod sections 48, i.e., the T-head is oriented as illustrated in FIG. 6, which is at 90° to its orientation in FIG. 17. The plunger 76 is seated on the bottom of the cage 52, whereby the stem 68 and the T-head 74 thereon are urged outwardly when the spring 77 is compressed. Pressure is exerted on the handle 72 to move the T-head 74 inwardly of the central portions 48*a* of the rod sections 48, against the pressure of the spring 77. The handle 72 then is rotated 90° in the clockwise direction, to rotate the T-head 74 to the position illustrated in FIG. 17, and the handle is released. The T-head under the pressure of the spring 77 thereupon moves into engagement with the central rod portions 48*a*. The locking nut 70 then is turned until it is closely adjacent to the body portion 60 of the casting, at which time the lifting apparatus 32 is ready for lifting the wall slab 34.

When the lifting operation is complete, and the wall slab 34 is in the raised position illustrated in FIG. 1, the pickup unit 42 is removed from the wall, for use repeatedly with other inserts. The particular fastening means 44 requires for removal of the pickup unit 42 that there be sufficient play between the locking nut 70 and the casting 58, to enable the stem 68 to be moved inwardly, by pressure on the handle 72, to free the T-head 74 for rotation clear of the central rod portions 48*a*, followed by withdrawal of the T-head between the rod portions 48*a*. This play in the past has been provided by manually loosening the locking nut 70 on the stem 68. The operating handle 72 then was grasped by the hand, pushed inwardly, and rotated 90° in the counterclockwise direction, to place the T-head 74 in a position in which it may be removed between the rod sections 48. The pickup unit 42 then was removed with the fastening means 44 by pulling on the bail 66 with the hand, to remove the bushing 78 and the T-head 74 from the hole 56 in the slab 34. The foregoing operations were performed by a workman on a ladder, as described above.

The remotely operable mechanism 30 of the present invention is operated from a distance to engage the operating handle 72, push in and rotate the stem 68 and the T-head 74 thereon, and then pull on the stem 68 and thereby remove the fastening means 44 together with the pickup unit 42 out of and away from the wall slab 34. To facilitate operation in this manner according to the preferred practice of the invention, the manner of mounting the pickup unit 42 on the wall 34 has been modified by inserting a spacer and bearing member 80 between the flange 62 of the casting 58 and the face of the wall slab 34. The spacer and the bearing member performs two functions: it spaces the casting 58 of the pickup unit 42 from the wall slab 34, and it serves as a bearing for protection of the surface of the slab 34 as the casting 58 moves thereon during the lifting operation. The spacer and bearing member 80 is removed from between the casting 58 and the slab 34 prior to engagement of the pickup unit 42 with the disconnecting mechanism 30. Removal of the spacer and bearing member 80 allows the stem 68 to be moved inwardly a distance equal to the thickness of the spacer, without need for loosening the locking nut 70. Consequently, the removal of the pickup unit 42 is readily accomplished by the disconnecting mechanism 30 operating solely by engagement with the handle 72.

Figure 18:
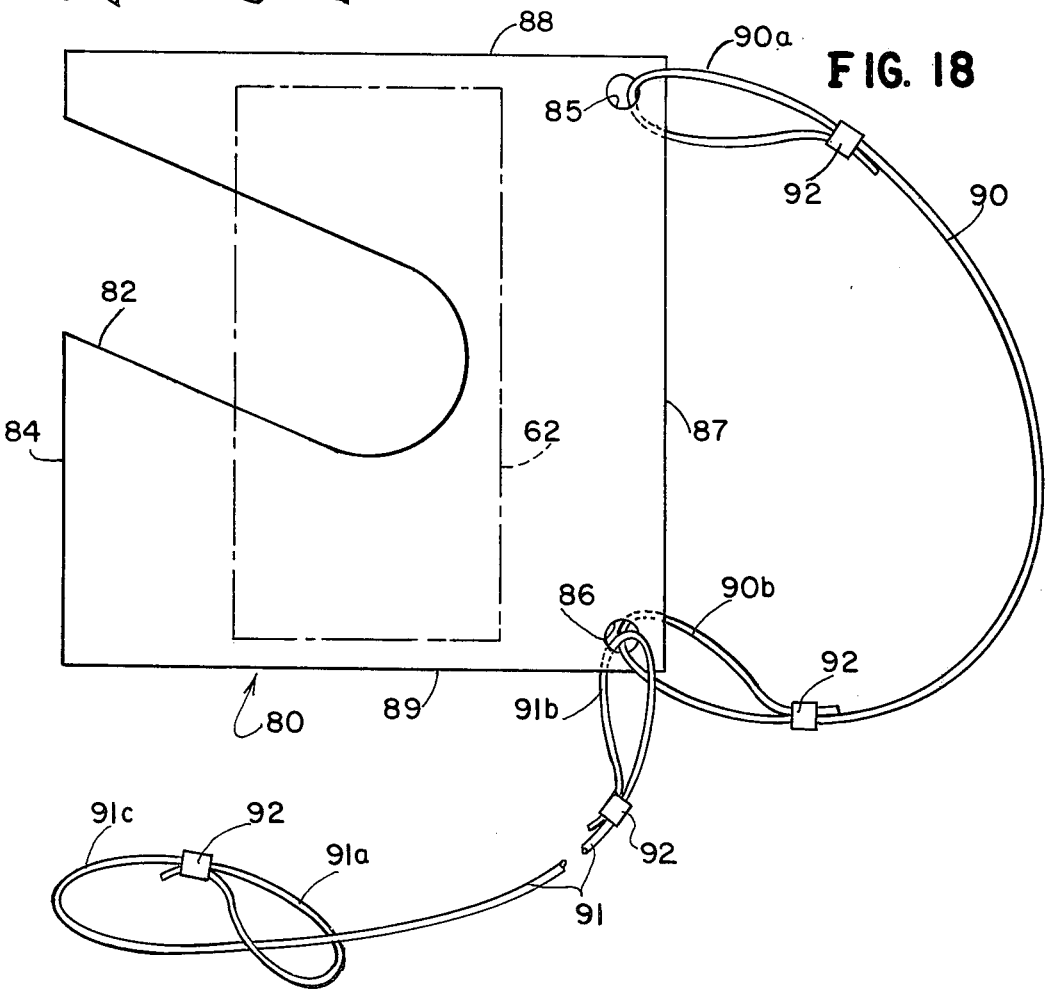
FIG. 18 is a further enlarged front elevational view of the spacer and bearing member, and two lanyards attached thereto.

Referring to FIGS. 17 and 18, the spacer and bearing member 80 in the preferred illustrative embodiment is constructed in the form of a smooth flat rectangular sheet of plastic material of high compressive strength, preferably having a minimum compressive strength of about 8,000 pounds per square inch. The material also has a low coefficient of friction. Suitable materials of construction include polyvinyl chloride and polyethylene. A particular material is Korolath, a product of Koro Corporation, Hudson, Massachusetts. The thickness of the spacer and bearing member 80, as viewed in FIG. 17, is a minimum of about one-fourth inch, and preferably is about three-eighths-one-half inch. The sheet of the illustrative embodiment is about 8 inches long by 8 inches wide. It is provided with a removal slot 82 extending from the center of the sheet to one edge 84 at an acute angle thereto. When the member 80 is in place, as shown in FIG. 17, the flange 62 of the casting 58 is centered thereon, as illustrated in broken lines in FIG. 18. The stem 68 extends through the slot 82 at about the inner end thereof. In the raised position of the wall slab 34, the slot 82 extends from the center of the sheet approximately in the 10 o'clock direction, i.e., it extends laterally and upwardly.

The small holes 85 and 86 are formed in the spacer and bearing member 80 adjacent to its edge 87 opposite to the slotted edge 84, and respectively adjacent to the edges 88 and 89 of the member which are the upper and lower edges in the raised position of the wall slab 34. Two lanyards 90 and 91 are connected to the member 80. Each of the lanyards 90 and 91 is in the form of a cable having small loops 90*a*, 90*b*, and 91*a*, 91*b*, respectively, secured by sleeve fasteners 92 at opposite ends thereof. One lanyard 90 functions as a spacer pull or handle, and its end loops 90*a* and 90*b* extend through the holes 85 and 86 in the member 80, to attach both ends of the lanyard thereto and thereby form a loop. The second lanyard 91 functions as a hanger for the member 80, and one of its end loops 91b extends through the lower hole 86 in the member, to attach one end of the lanyard thereto. The second lanyard 91 is pulled through its second end loop 91*a*, to form a large loop 91*c*. In use, the large loop 91*c* is placed around the stem 68 of the fastening means 44, behind the handle 72, as illustrated in FIG. 17. The lanyards 90 and 91 in the illustrative embodiment are constructed of short lengths of plastic-coated airplane cable having a coated diameter of about one-eighth inch, but may be constructed of any suitable material.

When the wall slab 34 is raised with the spacer and bearing member 80 in place, the member serves to protect the face of the wall 34 from wear and fracture. Thus, the casting 58 may rotate with respect to the slab 34 as the load is transferred to the crane cables, and the forces encountered in lifting the wall may also cause the casting 58 to bear unevenly on the slab surface beneath the flange 62. Previously, such forces caused wear and fracture, which required repair. The spacer and bearing member 80 minimizes such problems.

The spacer and bearing member 80 is removed from its position between the casting 58 and the wall slab 34 after the slab is raised and braced. The member 80 may be removed easily by engaging a hook on the end of a long pole with the lanyard 90, in the loop formed thereby. A downward pull on the lanyard serves to withdraw the member 80, which in the process rotates in the clockwise direction to about the 12 o'clock position of the removal slot 82 and moves downwardly, until the mouth of the slot 82 clears the stem 68 and is free to be pulled from beneath the lower edge of the flange 62. The member 80 remains suspended from the stem 68 by the second lanyard 91, with the large loop 91*c* around the stem, to be removed subsequently. At this time, the necessary play exists to enable the stem 68 to be manipulated by the disconnecting mechanism 30 in engagement with the handle 72, as described above.

Referring to FIGS. 11–16, the fastener coupling tool 38 has a proximal end 38*a* which is removably connected to the uppermost end of the pole assembly 36, and a free distal end 38*b* opposite thereto. The tool 38 includes a head 100 at the distal end 38*b*, a bolt part 102 at the proximal end 38*a*, a polygonal socket part 104 mounted on the bolt part, a universal joint 106 extending between and flexibly coupling the head and the bolt part, a retaining washer 108 around the universal joint, and a helical compression spring 110 interposed between the head and the socket part with its head end seated on the washer 108 adjacent the head.

The head 100 of the coupling tool 38 is a generally cup-shaped member which includes a circular base section 112 and an integral circular tubular side wall 114 forming the distal end 38*b* of the tool. The base section 112 is provided with a central square mounting opening 116 extending in the direction of the longitudinal axis 118 of the head 100 and of the extended tool 38, and a pin-receiving opening 120 extending through the base section and intersecting the mounting opening 116.

The side wall 114 defines a wide, generally cylindrical mouth 122 at the distal end 38*b* of the tool. The side wall 114 further defines a generally cylindrical bore 124 of reduced diameter, which extends longitudinally inwardly from the mouth 122 into the base section 112. Two bayonet slots 126 are formed in the side wall 114, in opposed relation. Each bayonet slot includes a portion 128 extending longitudinally inwardly from the mouth 122, and a portion 130 extending laterally or circumferentially from the inner end of the longitudinal portion. The laterally extending portions 130 are bounded by radially extending semicircular end walls 132. The bayonet slots 126 subdivide the side wall 114 of the hand into two jaws 134 and 136. The edges 138 and 140 on one of the jaws 136 and bordering the longitudinal slot portions 128 are flared. A concave lip 142 is formed on the same jaw 136.

The bolt part 102 has a central body 144, a generally square shank 146 extending longitudinally from the inner end of the body, and a threaded stem 148 extending longitudinally from the outer end of the body. The body 144 includes an inner cylindrical trunk section 150 and an outer enlarged polygonal shoulder section 152, which is hexagonal in the illustrative embodiment.

The universal joint 106 includes a first clevis member or yoke 154 having a square shank 156 and wings 158 extending from opposite ends thereof. The universal joint 106 includes a second clevis member or yoke 160, which has a tubular body 162 and wings 164 extending from the body. A solid connector 166 in rectangular block form is interposed between the clevis members 154 and 160.

The shank 156 of the first clevis member 154 is received in the square opening 116 in the head 100 and fixedly secured therein by a drive fit pin 168 inserted through the pin receiving opening 120 in the base section 112 and a registering opening in the shank 156. The second clevis member 160 receives the generally rectangular shank 146 of the bolt part 102 in a similarly shaped opening in its tubular body 162. A pin 170 is inserted through the body 162 and the shank 146 and fixedly secures the parts together.

The wings 158 and 164 of the clevis members 154 and 160 are rotated at 90° with respect to each other, and the wings of each clevis member are disposed on one pair of opposite sides of the connector 166. The wings 158 and 164 are pivotally secured to the connector 166 by respective pivot pins 172 and 174, the axes of which are oriented at 90° of rotation with respect to each other. In this manner, the universal joint 106 extends between and flexibly couples the head 100 and the bolt part 102, whereby rotation may be transmitted between them with their axes of rotation angularly disposed relative to each other.

The socket part 104 includes a side wall 176 and an inner end wall 178. The side wall 176 defines a polygonal socket 179, hexagonal in the illustrative embodiment, which is complementary to the shoulder section 152 of the bolt part 102. The end wall 178 has a central circular opening 180 therethrough and an annular shoulder 182 on the outer side thereof and facing inwardly of the tool 38. The end wall 178 receives the trunk section 150 of the bolt part 102 in its opening 180, and the end wall 178 is outwardly and inwardly slidable on the trunk section 150. The peripheral faces or sides of the shoulder section 152 of the bolt part 102 engage the side wall 176 of the socket part 104 to prevent relative rotation between the socket part and the bolt part when the shoulder section 152 is received within the socket 179. The inner end of the shoulder section 152 abuttingly engages the end wall 178 of the socket part 104 in the outermost disposition of the socket part, to retain the socket part on the bolt part 102. The socket part 104 may be moved longitudinally inwardly on the trunk section 150 of the bolt part 102, to permit a polygonal threaded nut member of like configuration to the shoulder section 152 and the socket 179 to be threaded on the stem 148 and moved adjacent to the shoulder section 152. The socket part 104 then may be moved outwardly for the purpose of securing the shoulder section 152 and such nut member against rotation relative to each other.

The retaining washer 108 is loosely seated on the first clevis member 154 therearound. An inwardly facing annular shoulder 184 is formed on the washer 108. The helical spring 110 surrounds the universal joint 106, and its opposite ends are seated in the shoulder 182 on the socket part 104, and on the shoulder 184 on the washer 108, respectively, whereby the spring exerts outward forces against the head 100 and the socket part 104, respectively. The spring 110 thus serves for extending the tool 38 longitudinally, in the direction of its axis 118, and for biasing the socket part 104 outwardly, while enabling the tool to bend or flex at the universal joint 106, with the axes of rotation of the head 100 and the bolt part 102 angularly disposed relative to each other. As illustrated in FIG. 16, the socket part 104 may be moved longitudinally inwardly on the bolt part body 144, against the bias of the spring 110, to expose the stem 148 completely for reception of a threaded nut thereon.

Referring to FIGS. 1–10, the pole assembly 36 includes a sectional pole 186, a guide member 188, and a fulcrum member 190. The guide and fulcrum members project laterally outwardly from the pole 186 at right angles thereto and, in the illustrative embodiment of these views, are spaced around the longitudinal axis of the pole 186 at an angle of about 100° between them.

The pole 186 in the illustrative embodiment is formed of a plurality of sections, for adjusting the length thereof. An uppermost first section 192 preferably is constructed of relatively stiff but flexible insulating material, and may be, for example, about 8 feet long. The next adjacent second section 193 and the remaining sections 194 have inside diameters slightly greater than the outside diameter of the first section 192, and are preferably constructed of lightweight tubular aluminum alloy, in 6 foot lengths, for example. The first and second sections 192 and 193 are telescopically adjustable with respect to each other, and the remaining sections 194 are add-on sections. Any suitable number of sections 194 may be employed, according to job requirements, to reach pickup units 42 which may be connected to the wall slab 34 at distances of 20 feet or more above ground level.

Figures 4, 5, 8:
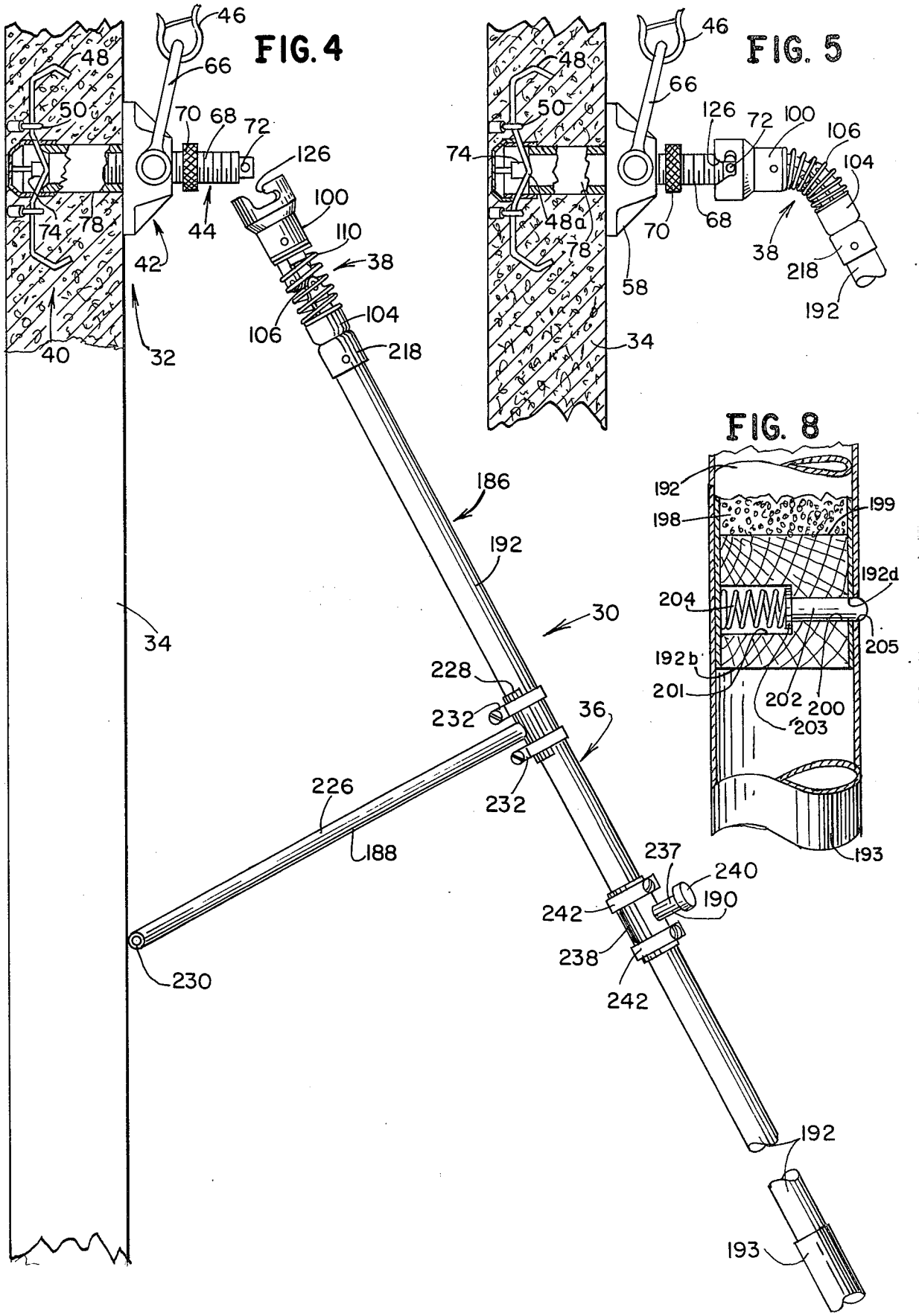
FIGS. 4–6 are enlarged fragmentary side elevational views of the mechanism, with parts broken away and in section, similar to FIGS. 1–3 and showing the mechanism in detail as it appears successively prior to, during and following the engagement with fastening means for the pickup unit which is illustrated in FIG. 1.
FIG. 8 is a still further enlarged longitudinal sectional detail view of a joint in the mechanism, taken substantially on line 8—8 of FIG. 1.

The first pole section 192 preferably is constructed like a lineman's insulating pole. As illustrated in FIG. 7, a tubular body 196 is constructed of synthetic resin filled with glass fibers, and the tubular body is filled with plastic foam 198, in the conventional manner for such poles. As illustrated in FIG. 8, the lower end **192*b* of the first pole section 192 carries a wooden or plastic dowel 199 or the like, which is provided with a radial latch pin-receiving bore 200 and an enlarged latch spring-receiving bore 201 aligned coaxially therewith. The bores 200 and 201 register with a latch pin hole 192*d* in the lower end 192*b* of the first pole section. A round-nosed latch pin 202 is inserted in the pin-receiving bore 200, and an enlarged head 203 on the pin is disposed in the spring-receiving bore 210. A helical compression latch spring 204 is inserted in the latter bore 210 behind the pin head 203. The spring resiliently urges the latch pin 202 outwardly, so that it extends through the pin hole 192*d***.

A series of five adjustment latch pin holes 205 (FIGS. 1 and 8) is provided in the second section 193, at preferred intervals of one foot. The pin holes 205 extend longitudinally from a location spaced one foot below the upper edge of the second section 193 to a location spaced one foot above the lower edge of the second section. The lower end **192*b* of the first pole section 192 is telescopically received in the upper end 193*a* (FIG. 1) of the second section 193, and the pin hole 192*d* in the first section registers with a selected adjustment pin hole 205 in the second section. The latch pin 202 extends radially through the registering pin holes, to secure the first and second sections 192 and 193 together in a selected longitudinally adjusted relation. The two pole sections 192 and 193 may be disconnected for adjustment or for separating them from each other by pushing the nose of the pin 202 inwardly through the adjustment pin hole 205, whereupon the sections may be moved longitudinally relative to each other. The length of the combined pole sections 192 and 193, and of the complete pole 186**, may be adjusted in 1-foot increments by this structure. .

Referring to FIGS. 1 and 9, the remaining sections 194 of the pole 186 are detachably interconnected and one of the sections 194 is detachably connected to the second section 193 by means latching or locking telescoping ends thereof together. FIG. 9 illustrates the latching means for two adjoining sections 194, and like means, not illustrated, are employed for latching the second section 193 to the adjoining remaining section 194. Thus, the lower end **194*b* of each of the remaining pole sections 194 and the lower end of the second section 193 are reduced in diameter, so as to be telescopically received in the upper end 194*a* of each of the adjacent pole section 194. The lower end 194*b* of each of the remaining pole sections 194 carries a wooden dowel 206 or the like, which is provided with a radial latch pin-receiving bore 208 and an enlarged latch spring-receiving bore 210 aligned coaxially therewith. Registering pin holes 194*c* and 194*d* are provided in the telescoping upper and lower ends, respectively, of the pole sections, in register with the latch pin-receiving bore 208. A round-nosed latch pin 212 is inserted in the pin-receiving bore 208, and an enlarged head 214 on the pin is disposed in the spring-receiving bore 210. A helical compression latch spring 216 is inserted in the spring-receiving bore 210 behind the pin head 214. The spring resiliently urges the latch pin 212 outwardly, so that it extends through the pin holes 194*c* and 194*d*, to latch or lock the telescoping pole sections 194 together. Two pole sections 194 may be separated from each other by pushing the nose of the pin 212 inwardly through the pin hole 194*c* in the telescoping upper end 194*a*** of the lower section, whereupon the sections may be pulled apart.

Referring to FIG. 7, a cup-shaped cap or ferrule 218 is secured to the upper end **192*a* of the first pole section 192 by a pin connection 220 extending through the two members. A circular opening 222 is formed in the end of the cap 218. A polygonal locating member 224 in the form of a threaded hexagonal nut is fixed to the end of the cap 218, as by welding, with the threaded opening of the locating member registering with the opening 222 in the cap. The locating member 224 is threadedly received on the stem 148 projecting from the proximal end 38*a* of the coupling tool 38. The portion of the stem 148 which extends through the locating member 224 is accommodated by the opening 222 in the cap 218**.

The locating member 224 has the same configuration as the shoulder section 152 on the bolt part 102 and the socket 179 in the socket part 104. The locating member 224 may be threaded on the stem 148 by rotating the first pole section 192, or the assembled pole 186, while the socket part 104 is retracted in the manner illustrated in FIG. 16. The first pole section 192 may be rotated to any one of six positions of rotation relative to the coupling tool 38, corresponding to the six faces of the polygonal members, which are brought into alignment with each other. When the first pole section 192 and the locating member 224 fixed thereto have been placed in a selected position of rotation relative to the tool 38, the socket part 104 of the tool is released to engage the locating member 224 in the socket .179 thereof. In this condition of the tool 38, the pole section 192 and the tool, particularly the head 100 thereof, are secured together against relative rotation.

While the structure of the illustrative embodiment is preferred, it will be apparent that, alternatively, parts may be transposed, and an externally threaded stem or the like may be fixed to the locating member 224 and threaded into a structure such as the bolt part body 144, drilled and tapped to provide an internal thread and absent the stem 148, the latter structure then functioning as a nut.

Referring to FIGS. 1, 4 and 10, the guide member 188 is constructed of a tubular rod part 226 welded at its inner end to a base 228 and welded at its outer end to a runner 230. The base 228 is in the form of a half sleeeve, which is seated on the first section 192 of the pole 186 and secured thereon by a pair of hose-type clamps 232. The rod part 226 is welded to the center of the base 228, as indicated at 234, and the rod part extends perpendicularly therefrom, to project radially outwardly from the pole 186 as mounted. The runner 230 is a short (preferably about 7-inch) piece of tubing like the rod part 226. The rod part 226 is welded to the center of the runner 230, so that the runner extends perpendicularly from opposite sides of the rod part. The runner 230 extends horizontally when being used.

Referring to FIGS. 2, 3 and 6, the fulcrum member 190 is constructed of a tubular rod part 237 secured to a base 238 at its inner end and having an elastomeric cup 240 mounted on its outer end. The base 238 is in the form of a half sleeve, and it is seated on the first section 192 of the pole 186 and secured thereto by a pair of hose-type clamps 242. The inner end of the rod part 236 is secured to the center of the base 238 by welding, as indicated at 244, and the rod part is perpendicular to the base, thus projecting radially outwardly from the pole 186 as mounted.

In the illustrative embodiment, the guide member 188 is spaced from the upper end of the first section 192 a distance of about 16 inches, and the rod part 226 of the guide member extends outwardly for a distance of about 16 inches. The fulcrum member 190 is spaced downwardly from the guide member a distance of about 8 inches, and the rod part 237 of the fulcrum member extends outwardly for a distance of about 16 inches. The guide member 188 and the fulcrum member 190, particularly the rod parts 226 and 237 thereof, are angularly spaced from each other around the longitudinal axis of the pole 186, at a preferred angle of about 100° in the illustrative embodiment. The foregoing spacings are readily adjusted as may be desirable, by loosening the clamps 232 and/or 242 for that purpose and then tightening them once more.

In operation with the disconnecting mechanism 30 and in the manner illustrated in FIGS. 1–18, the lifting apparatus 32 is connected in multiple to a concrete wall slab 34 as described above, with a spacer and bearing member 80 inserted between each pickup unit 42 and the slab. The slab 34 is erected with the aid of a crane having cables connected to hooks 46, and each hook is connected to the bail 66 of a pickup unit 42. In one common construction method, illustrated in FIG. 1, the wall slab 34 is poured on a floor slab 246 and then lifted therefrom by the crane. The wall slab 34 is erected on a footing 248, and the slab remains separated from the floor slab 246 by a void 250, which may be 2–3 feet wide, the void being subsequently filled with concrete.

When the slab 34 is erected in the position illustrated in FIG. 1, the spacer and bearing member 80 is removed from beneath each pickup unit 42 by pulling downwardly on its lanyard 90, as described above. The member 80 remains suspended from the item 68, by the second lanyard 91, looped therearound as shown in FIG. 17. For convenience of illustration, the suspended member 80 is not shown in FIGS. 1–6. The disconnecting mechanism 30 next is operated in the manner illustrated in FIG. 4, to bring the mechanism into engagement with the fastening means 44. The pole 186 serves as an operating handle, and the pole is manipulated by an operator to slide the horizontal runner 230 of the guide member 188 upwardly on the face of the wall slab 34, directing the head 100 of the coupling tool 38 towards the handle 72 on the fastening means 44. The guide member 188 enables the operator to align the tool head 100 rapidly with the handle 72, whereas in the absence of the guide member, the operation is somewhat difficult at the heights involved.

The tool head 100 makes contact with the stem 68, with the concave lip 142 on the lower jaw 136 thereof accommodating the curvature of the stem. The handle 72 is received in the bayonet slots 126, the flared edges 138 and 140 of which assist in guiding the handle 72 into a position extending transversely or diametrically through the side wall 114. As illustrated in FIG. 5, the tool 38 bends at the U-joint 106 as the pole 186 is pushed upwardly into engagement of the tool head 100 with the handle 72. The overall appearance of the disconnecting mechanism 30 and the lifting apparatus 32 at this time is illustrated in FIG. 1.

The pole 186 next is rotated about 10° counterclockwise, to rotate the tool head 100 to the same extent and bring the end walls 132 bordering the bayonet slots 126 (FIGS. 11–14) into engagement with the opposite ends of the handle 72. The pole 186 then is pushed inwardly and rotated for 90° in the counterclockwise direction, to place the mechanism 30 and the lifting apparatus 32 in the condition illustrated in FIG. 6. Thus, the inward force on the tool 38 is transmitted through the handle 72 to the stem 68 of the fastening means 44, moving the stem inwardly against the bias of the spring 77 (see FIG. 17). Once the T-head 74 has been cleared for rotation behind the central rod portions 48a, the stem 68 and the T-head 74 thereon may be rotated, by rotation of the pole 186 and thereby the tool head 100. After the 90° rotation, the T-head 74 is oriented so that it may be removed from engagement with the insert 40, by withdrawal between the rod sections 48. The fulcrum member 190 extends towards the wall slab 34, in a plane generally perpendicular thereto.

The pickup unit 42 next is removed from the wall slab 34, in the manner illustrated in FIGS. 2 and 3. The lower end of the pole 186 is moved inwardly towards the slab 34, until the fulcrum member 190, particularly the cup 240 on the end of the rod part 237 thereof, bears on the face of the wall slab, as illustrated in FIG. 2. Upon further inward movement of the lower end of the pole 186, as illustrated in FIG. 3, the pole functions as a lever of the first class for pulling the fastening means 44, engaged by the tool 38, away from the wall slab. Owing to its engagement with the fastening means 44, the pickup unit 42 also is pulled away from the wall slab. In the process, the first pole section 192 flexes and puts the fastening means 44 under tension, to spring the fastening means and pickup and unit out of the wall slab. The removal of the pickup unit is accomplished with the operator standing well away from the void 250 at the base of the wall slab 34.

The pickup unit 42, the fastening means 44 and the spacer member 80 thereon may be supported on the crane hook 46 while the tool 38 is disengaged from the handle 72. The pole 186 is rotated about 10° in the clockwise direction, thereby rotating the tool head 100 a like amount. The handle 72 becomes aligned with the longitudinally extending portions 128 of the bayonet slots 126, so that the tool 38 may be removed from the fastening means 44 simply by moving the pole 186 outwardly. The pickup unit 42, fastening means 44 and spacer member 80 suspended by the crane hook 46 may be lowered to the ground by the crane operator.

Alternatively, where open crane hooks are used, the crane cables may be slackened prior to engagement of the fastening means 44 by the mechanism 30, to detach the hooks from the bails 66 of the pickup units 42. After each pickup unit 42 is removed from the wall slab 34 as illustrated in FIG. 3, the fastening means 44 may remain in engagement with the tool 38. The tool 38 may be lowered with the pickup unit against the face of the slab 34, to "walk" the pickup unit down the slab to the ground level.

While it is recommended that the insert 40 be embedded in the wall 34 in the orientation illustrated in the several drawing views, the recommendation may not be followed, and the insert may be found to be oriented in other ways. In such event, it may be necessary to employ the guide member 188 and the fulcrum member 190 in rotational positions relative to the tool head 100 which are different from the positions illustrated. The proper relative rotation is achieved by making the connection between the tool 38 and the pole 186, illustrated in FIG. 7, with a suitable degree of rotation of the locating member 224 relative to the stem 148 on which it is threaded.

Figure 19:
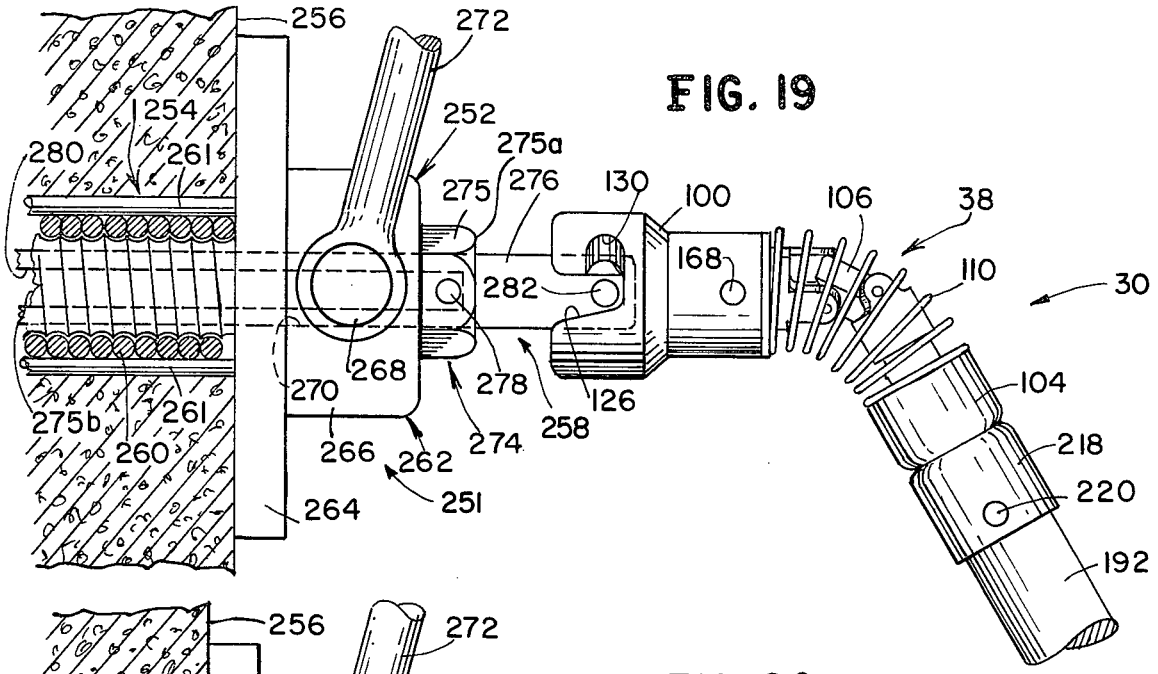
FIGS. 19 and 20 are sequential fragmentary and broken side elevational and partly sectional views showing the mechanism of the invention employed for disconnecting the pickup unit of another form of lifting apparatus, the unit being secured by a different type of fastening means.
Figure 20:
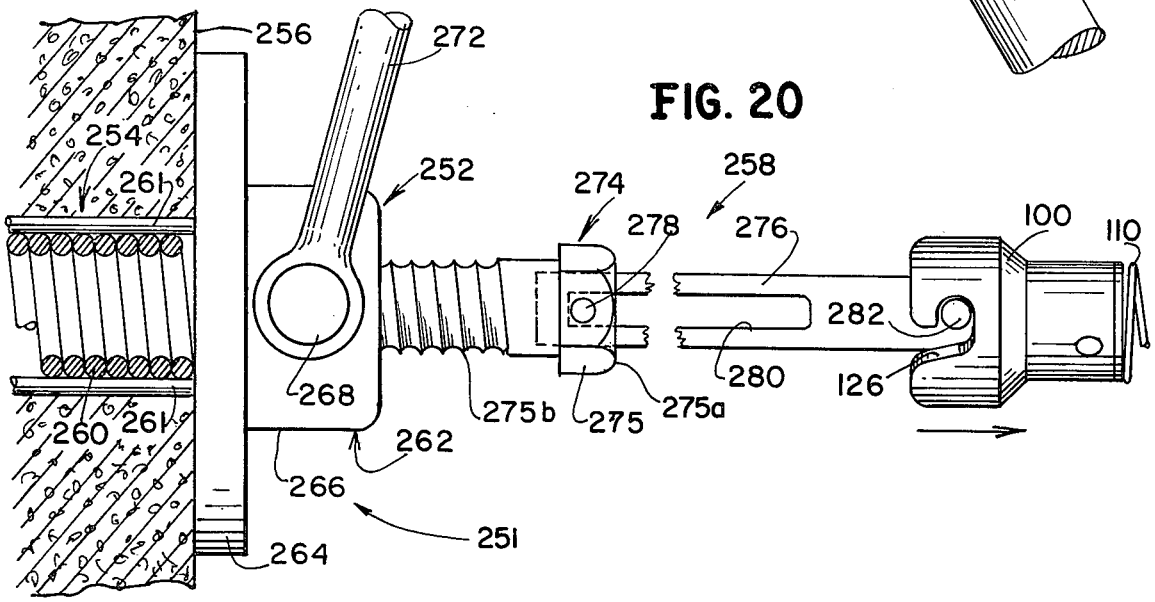

FIGS. 19 and 20 illustrate a combination of the disconnecting mechanism 30 and lifting apparatus 251, in accordance with another embodiment of the invention. The lifting apparatus 251 is conventional and includes a pickup unit 252 and an insert 254. The insert 254 is embedded in a concrete wall slab 256, and the pickup unit 252 is removably connected to the insert by fastening means 258. The mechanism 30 is remotely operable for disconnecting an elevated pickup unit 252 from the wall slab 256 when the slab is in raised position following a lifting operation.

The lifting apparatus 251 and the fastening means 258 are disclosed in modified form in U.S. Pat. No. 3,456,547. Thus, the insert 254 is constructed of a coil 260 of heavy wire forming a nut member, and a plurality of legs 261 of heavy wire extending longitudinally of the coil and fixedly secured to the outer surface thereof, as by welding. The legs 261, shown but fragmentarily, serve to support the insert 254 on the floor of a concrete form while a wall slab 256 is poured, and the legs also serve to anchor the coil 260 in the slab.

The pickup unit 252 includes a casting 262 having a base 264, a body 266 integral with the base, and a pair of trunnions 268 integral with the body and extending radially outwardly from opposite sides of the body. A cylindrical bolt-receiving passageway 270 extends axially through the casting 262. A bail 272 is pivotally mounted on the trunnions 268, for connection to a crane hook or other lifting equipment, as with the embodiment of FIG. 17.

The fastening means 258 includes a longitudinally split threaded bolt 274 having two segments 275 similar to the segments 60 and 61 shown in FIG. 5 of U.S. Pat. No. 3,456,547, and a shim or actuating member 276 similar to the key 62 shown in the same figure of the patent, the structures of the patent being modified, however, in the commercial embodiment thereof illustrated herein. The bolt segments 275 are joined together by a pin 278 that extends transversely through the head portions **275*a* of the bolt segments. The shim 276 is an elongated bar member having a closed longitudinal slot 280 therein. A crosspin-type handle 282 is fixedly mounted in the shim 276** adjacent an outer end thereof, and the handle extends laterally outwardly from opposite sides of the shim.

The shim 276 is adapted to enter between the bolt segments 275, and is held captive on the bolt by the pin 278, which extends through the slot 280 in the shim. When the shim 276 is pulled longitudinally as far out of the bolt 274 as it will go, the bolt segments 275 may be moved together or collapsed, so that the bolt 274 is easily insertable through the passageway 270 in the casting 262 and into the coil 260. The shim 276 then may be pushed longitudinally into the bolt 274, by pressure applied to the handle 282, which causes the bolt segments 275 to be moved apart. When the shim 276 is pushed all the way in, as illustrated in FIG. 19, the shank portions **275*b* of the bolt segments 275 are in tight threaded engagement with the coil 260, to thereby connect the pickup unit 252 to the insert 254**, ready for a lifting operation.

After raising the wall slab 256 and with the pickup unit 252 then in an elevated position, the disconnecting mechanism 30 may be engaged with the fastening means 258 in a manner similar to the engagement with the fastening means 44 in the preceding embodiment of the invention. Thus, the mechanism 30 may be moved up into engagement with the fastening means 258 in the manner illustrated for the preceding embodiment in FIGS. 4 and 5, as described above. At this time, and referring to FIG. 19, the handle 282 will have been received in the bayonet slots 126 of the tool head 100.

The handle 282 on the shim 276 is further engaged by the tool head 100, by rotating the pole 186 and thereby the tool head in the counterclockwise direction about 10°, so that the handle 282 is received in the laterally extending portions 130 of the bayonet slots 126. This disposition of the tool head 100 is illustrated in FIG. 20. When the fulcrum member 190 is disposed as illustrated in FIG. 2, bearing on the wall slab 256 of FIG. 20, and the lower end of the pole 186 is moved inwardly, the tool 38 is pulled outwardly, to withdraw the shim 276 from the bolt segments 275 and cause the bolt 274 to collapse, as illustrated in FIG. 20. The shim 276 is pulled outwardly to its farthest extent with respect to the bolt 274, and then engages the pin 278 at the end of the slot 280, to pull the collapsed bolt 274 out of the insert 254 and out of the pickup unit 252. The pickup unit 252 remains suspended on a crane hook attached to the bail 272, to be lowered to the ground subsequently. The fastening means 258, in engagement with the tool head 100, may be lowered to the ground by means of the mechanism 30.

FIGS. 21 and 22 illustrate, respectively, modified disconnecting mechanisms 30' and 30'' according to the invention, having tool heads 100' and 100'' modified for engagement with bolt-type fastening means and otherwise constructed like the mechanism 30 employed in the preceding embodiments. In each of the embodiments of FIGS. 21 and 22, lifting apparatus 251 like the correspondingly numbered apparatus of FIGS. 19 and 20 is employed, the apparatus including an insert 254 embedded in a concrete wall 256 and having a pickup unit 252 connected thereto, as described in connection with FIGS. 19 and 20. However, different fastening means are employed and removed by the disconnecting mechanisms in the embodiments of FIGS. 21 and 22. Prime numbers are employed in these views, to identify parts of the mechanisms similar to but varying structurally from parts illustrated in preceding views and identified by the same numerals, and identical parts are identified in the same manner as in the preceding views.

The fastening means in the embodiment of FIG. 21 constitutes a bolt 284 having a shank 286 threaded for engagement with the coil 260 of the insert 254 therein, and an integral hexagonal head 288. Lifting assemblies of the type represented by the lifting apparatus 251 and the bolt 284 are used frequently, although they do not have the quick-disconnect and other features of the structure illustrated in FIG. 17. The disconnecting mechanism 30' is modified for removing the bolt 284, by constructing the head 100' of the coupling tool 38' with a modified side wall 114'. The side wall 114' is constructed to define a hexagonal socket 290 complementary to the hexagonal bolt head 288. Otherwise, the structure of the disconnecting mechanism 30' is like the structure of the mechanism 30 of the preceding embodiments.

The mechanism 30' is aligned and engaged with the bolt 284 similarly to the operation illustrated and described for the first-described embodiment, with reference to FIGS. 4 and 5. When the tool head 100' is in engagement with the bolt head 288, the bolt head being received in the socket 290, the pole 186 is rotated in the counterclockwise direction until the bolt 284 is completely unthreaded from the insert 254. The bolt then may be withdrawn from the casting 262 and dropped to the ground. The pickup unit 252 remains suspended by engagement of a crane hook with the bail 272. The pickup unit 252 may be lowered to the ground by the crane, as described for the preceding embodiments.

In the embodiment of FIGS. 22 and 23, a modified bolt 292 is employed as the fastening means securing the pickup unit 252 to the insert 254. The bolt 292 includes a shank 294 threadedly engaging the coil 260 of the insert 254 therein, and a hexagonal head 296 integral with the outer end of the shank 294. A crosspin 298 is welded to extend diametrically across the outer surface of the bolt head 296 and laterally outwardly from opposite sides thereof. The head 100'' of the tool 38'' in the mechanism 30'' is modified for engagement with the bolt 292, and the mechanism 30'' otherwise is like the disconnecting mechanism 30 of the first embodiment. Thus, the side wall 114'' of the tool head 100'' is constructed similarly to the side wall 114 of the tool head 100 in the first embodiment, including the provision of bayonet slots 126'' similar to the bayonet slots 126 of the first embodiment. The inner surface of the side wall 114'' is modified to allow the hexagonal head 296 of the bolt 292 to rotate freely in the tool head 100''.

The mechanism 30'' of the embodiment of FIGS. 22 and 23 is aligned and engaged with the bolt 292 and the crosspin 298 thereof in a manner similar to the operation with the first embodiment of the mechanism 30 as illustrated in FIGS. 4 and 5. Upon engagement as illustrated in FIG. 22, the pole 186 is rotated in the counterclockwise direction about 10°, whereby the tool head 100 is rotated a like amount. The crosspin 298 is engaged by the tool head 100'' in the laterally extending portions 130'' of the bayonet slots 126'', as illustrated in FIG. 23. Continued counterclockwise rotation of the pole 186 and the tool head 100'' therewith unscrews the bolt 292 from the coil 260 in the insert 254, until the bolt may be removed completely from the insert and from the casting 262. At that time, the bolt 292 is engaged by the tool head 100'' and may be lowered to the ground thereby. The pickup unit 252 remains supported by the crane hook and may be lowered to the ground by operation of the crane.

The invention thus provides disconnecting mechanism the use of which overcomes the disadvantages of prior methods of disconnecting elevated pickup units from raised wall slabs. A relatively lightweight structure may be constructed, which can be operated easily and quickly by one man. The operator works from a position well removed from the void or trench 250 at the base of the slab 34, and the necessity for working on a ladder is eliminated, to increase the safety of operation.

While several preferred embodiments of the invention have been illustrated and described, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. The combination of lifting apparatus for a tilt-up concrete wall slab, said apparatus including an insert for embedment in the slab and a pickup unit to be removably connected to the slab by fastening means releasably engaging the insert, and a remotely operable mechanism for disconnecting an elevated pickup unit from the slab when the latter is in a raised position following a lifting operation, said mechanism comprising:

an elongated element serving as an operating handle and having uppermost and lowermost ends when in use, means on said element adjacent to its uppermost end for engaging said fastening means and operable to release the fastening means from said insert in order thereby to disconnect said pickup unit for removal from the slab, said engaging means being movable into its engagement with said fastening means and operable when the latter is disposed at a location above and remote from an operator of the mechanism by manipulation of said element grasped adjacent to its lowermost end, and fulcrum means associated with said element and adapted to effect pivotal movement of the element whereby movement of the lowermost end of the element causes the element to function as a lever for pulling said fastening means away from the slab.

2. The combination of lifting apparatus for a tilt-up concrete wall slab, said apparatus including an insert for embedment in the slab and a pickup unit to be removably connected to the slab by fastening means releasably engaging the insert, and a remotely operable mechanism for disconnecting an elevated pickup unit from the slab when the latter is in a raised position following a lifting operation, said mechanism comprising:

a manipulating pole serving as an operating handle and having uppermost and lowermost ends when in use, a flexible fastener coupling tool having a proximal end connected to said uppermost end of the pole and a free distal end opposite thereto, said tool having at said distal end a head engageable with said fastening means and operable for disengaging the same from said insert to thereby release said pickup unit for removal from the slab, said tool including a universal joint extending between and flexibly coupling said head and said proximal end thereof, whereby the tool head may be rotated by rotation of said pole while the pole is angularly disposed relative to the axis of rotation of the head, said tool also including spring means interposed between said head and said proximal end thereof for extending the tool coaxially with said pole while enabling the tool to bend for engaging the head with said fastening means, said tool head being movable into its engagement with said fastening means and operable when the latter is disposed at a location above and remote from an operator of the mechanism by manipulation including rotation of said pole grasped adjacent to its lowermost end, and a fulcrum member projecting laterally outwardly from said pole and adapted to bear on the raised slab upon movement of the lowermost end of the pole towards the slab, whereby the pole functions as a lever for pulling said tool and fastening means engaged thereby away from the slab.

3. A combination as defined in claim 2 and wherein said tool head includes a tubular side wall provided with opposed bayonet slots for engagement of the head with a crosspin-type handle on said fastening means, and said proximal end of the tool and said uppermost pole end are provided with connecting means whereby the tool head and the pole may be secured at selected positions of rotation relative to each other for adjusting the rotational position of said fulcrum member so as to bear on said slab when the tool head is in engagement with the fastening means and the fastening means is disengaged from said insert and ready to be pulled outwardly from the slab.

4. A combination as defined in claim 3 and wherein said connecting means includes on said connected ends a stem extending longitudinally from one of the ends into threaded engagement with a nut member on the remaining end, a polygonal socket part of said tool longitudinally slidable and secured against rotation with respect to the remainder of the tool, and a polygonal locating member complementary to the socket part fixedly mounted on the uppermost pole end for reception in the socket part at a selected position of rotation relative thereto to thereby secure the tool head and the pole at their said selected positions of relative rotation, said spring means biasing said socket part in the direction of said proximal end for releasably securing said locating member therein.

5. A combination as defined in claim 2 and including a guide member projecting laterally outwardly from said pole and angularly spaced from said fulcrum member around the axis of the pole, said guide member being adapted to travel on the raised slab as the pole is moved upwardly, thereby assisting in aligning said tool head with said fastening means for bringing them into said engagement thereof.

6. The combination of lifting apparatus for a tilt-up concrete wall slab, said apparatus including an insert for embedment in the slab and a pickup unit to be removably connected to the slab by fastening means releasably engaging the insert, and a remotely operable mechanism for disconnecting an elevated pickup unit from the slab when the latter is in a raised position following a lifting operation, said mechanism comprising:

a manipulating pole serving as an operating handle and having uppermost and lowermost ends when in use, a flexible fastener coupling tool having a proximal end connected to said uppermost end of the pole and a free distal end opposite thereto, said tool having at said distal end a head engageable with said fastening means and operable for disengaging the same from said insert to thereby release said pickup unit for removal from the slab, said tool including a universal joint extending between and flexibly coupling said head and said proximal end thereof, whereby the tool head may be rotated by rotation of said pole while the pole is angularly disposed relative to the axis of rotation of the head, said tool also including spring means interposed between said head and said proximal end thereof for extending the tool coaxially with said pole while enabling the tool to bend for engaging the head with said fastening means, said tool head being movable into its engagement with said fastening means and operable when the latter is disposed at a location above and remote from an operator of the mechanism by manipulation including rotation of said pole grasped adjacent to its lowermost end, and a guide member projecting laterally outwardly from said pole and adapted to travel on the raised slab as the pole is moved upwardly, thereby assisting in aligning said tool head with said fastening means for bringing them into said engagement thereof.

7. In a remotely operable mechanism for disconnecting an elevated pickup unit component of lifting apparatus from a tilt-up concrete wall slab in a raised position following a lifting operation, said lifting apparatus also including an insert embedded in the slab and the pickup unit being removably connected to the slab by fastening means releasably engaging the insert, the combination of:

a manipulating pole serving as an operating handle and having uppermost and lowermost ends when in use, a flexible fastener coupling tool having a proximal end connected to said uppermost end of the pole and a free distal end opposite thereto, said tool having at said distal end a head engageable with said fastening means and operable for disengaging the same from said insert to thereby release said pickup unit for removal from the slab, said tool including a universal joint extending between and flexibly coupling said head and said proximal end thereof, whereby the tool head may be rotated by rotation of said pole while the pole is angularly disposed relative to the axis of rotation of the head, said tool also including spring means interposed between said head and said proximal end thereof for extending the tool coaxially with said pole while enabling the tool to bend for engaging the head with said fastening means, said tool head being movable into its engagement with said fastening means and operable when the latter is disposed at a location above and remote from an operator of the mechanism by manipulation including rotation of said pole grasped adjacent to its lowermost end, and a fulcrum member projecting laterally outwardly from said pole and adapted to bear on the raised slab upon movement of the lowermost end of the pole towards the slab, whereby the pole functions as a lever for pulling said tool and fastening means engaged thereby away from the slab.

8. A mechanism as defined in claim 7 and including a guide member projecting laterally outwardly from said pole and angularly spaced from said fulcrum member around the axis of the pole, said guide member being adapted to travel on the raised slab as the pole is moved upwardly, thereby assisting in aligning said tool head with said fastening means for bringing them into said engagement thereof.

9. In a remotely operable mechanism for disconnecting an elevated pickup unit component of lifting apparatus from a tilt-up concrete wall slab in a raised position following a lifting operation, said lifting apparatus also including an insert embedded in the slab and the pickup unit being removably connected to the slab by fastening means releasably engaging the insert, the combination of:

a manipulating pole serving as an operating handle and having uppermost and lowermost ends when in use, a flexible fastener coupling tool having a proximal end connected to said uppermost end of the pole and a free distal end opposite thereto, said tool having at said distal end a head engageable with said fastening means and operable for disengaging the same from said insert to thereby release said pickup unit for removal from the slab, said tool including a universal joint extending between and flexibly coupling said head and said proximal end thereof, whereby the tool head may be rotated by rotation of said pole while the pole is angularly disposed relative to the axis of rotation of the head, said tool also including spring means interposed between said head and said proximal end thereof for extending the tool coaxially with said pole while enabling the tool to bend for engaging the head with said fastening means, said tool head being movable into its engagement with said fastening means and operable when the latter is disposed at a location above and remote from an operator of the mechanism by manipulation including rotation of said pole grasped adjacent to its lowermost end, and a guide member projecting laterally outwardly from said pole and adapted to travel on the raised slab as the pole is moved upwardly, thereby assisting in aligning said tool head with said fastening means for bringing them into said engagement thereof.

10. In a remotely operable mechanism for disconnecting an elevated pickup unit component of lifting apparatus from a tilt-up concrete wall slab in a raised position following a lifting operation, said lifting apparatus also including an insert embedded in the slab and the pickup unit being removably connected to the slab by fastening means releasably engaging the insert, the combination of:

a manipulating pole serving as an operating handle and having uppermost and lowermost ends when in use, a flexible fastener coupling tool having a proximal end removably connected to said uppermost end of the pole and a free distal end opposite thereto, said tool having at said distal end a head releasably engageable with said fastening means and operable for disengaging the same from said insert to thereby release said pickup unit for removal from the slab, said tool including a universal joint extending between and flexibly coupling said head and said proximal end thereof, whereby the tool head may be rotated by rotation of said pole while the pole is angularly disposed relative to the axis of rotation of the head, said proximal end of the tool and said uppermost pole end being provided with connecting means including a stem extending longitudinally from one of the ends into threaded engagement with a nut member on the remaining end, a polygonal socket part of the tool longitudinally slidable and secured against rotation with respect to the remainder of the tool, and a polygonal locating member complementary to the socket part fixedly mounted on the uppermost pole end for reception in the socket part at a selected position of rotation relative thereto to thereby secure the tool head and the pole at selected positions of relative rotation, said tool also including spring means interposed between said head and said socket part for extending the tool coaxially with said pole while enabling the tool to bend for engaging the head with said fastening means, said spring means also biasing said socket part in the direction of said proximal end for releasably securing said locating member therein, said tool head being movable into its engagement with said fastening means and operable when the latter is disposed at a location above and remote from an operator of the mechanism by manipulation including rotation of said pole grasped adjacent to its lowermost end, and a fulcrum member projecting laterally outwardly from said pole and adapted to bear on the raised slab upon movement of the lowermost end of the pole towards the slab, whereby the pole functions as a lever for pulling said tool and fastening means engaged thereby away from the slab.

11. A mechanism as defined in claim 10 and including a guide member projecting laterally outwardly from said pole and angularly spaced from said fulcrum member around the axis of the pole, said guide member being adapted to travel on the raised slab as the pole is moved upwardly, thereby assisting in aligning said tool head with said fastening means for bringing them into said engagement thereof.

12. A mechanism as defined in claim 10 and wherein said tool head includes a tubular side wall provided with opposed bayonet slots for engagement of the head with a crosspin-type handle on said fastening means.

13. A mechanism as defined in claim 10 and wherein said connecting means includes a bolt part having a central body and said stem at one end of the body, the opposite end of said body being connected to said universal joint, said body mounting said socket part for non-rotatable longitudinal sliding movement thereon.

14. The combination of lifting apparatus for a tilt-up concrete wall slab, said apparatus including an insert for embedment in the slab and a pickup unit to be removably connected to the slab by fastening means releasably engaging the insert, said fastening means including an actuating member securing the fastening means to the insert and movable in a direction away from the slab in order to release the fastening means from the insert and thereby render the pickup unit removable from the slab, and a remotely operable mechanism for disconnecting an elevated pickup unit from the slab when the slab is in a raised position following a lifting operation, said mechanism comprising:

means for engaging the actuating member, lever means connected to said engaging means for moving said actuating member in a direction away from said slab upon pivotal movement of the lever means, fulcrum means associated with said lever means and adapted to effect said pivotal movement, and operating means connected to said lever means and operable from ground level pivotally to move the lever means while said engaging means engages said actuating member, thereby to disconnect the pickup unit from the slab.

* * * * *